United States Patent [19]

Weyer

[11] Patent Number: 4,906,161

[45] Date of Patent: Mar. 6, 1990

[54] TILTABLE BUCKET ASSEMBLY

[76] Inventor: Paul P. Weyer, 48811 - 284th Avenue S.E., Enumclaw, Wash. 98022

[21] Appl. No.: 229,023

[22] Filed: Aug. 5, 1988

Related U.S. Application Data

[63] Continuation-in-part of Ser. No. 126,837, Nov. 30, 1987.

[51] Int. Cl.[4] ..... E02F 5/02

[52] U.S. Cl. ..... 414/705; 414/723; 37/103

[58] Field of Search ..... 414/723, 722, 705; 37/103

[56] References Cited

U.S. PATENT DOCUMENTS

| | | | |
|---|---|---|---|
| 4,042,131 | 8/1977 | Buttke | 414/705 X |
| 4,277,899 | 7/1981 | Güthoff | 37/103 |
| 4,639,183 | 1/1987 | Güthoff | 414/705 |

OTHER PUBLICATIONS

Raine, "Tilt Bucket", B1192-8(2-88).

Wain-Roy, Inc., "The Wain-Roy® Rota-Jaw Bucket" WR-002 CP-10M-2/85.

*Primary Examiner*—Robert J. Spar
*Assistant Examiner*—James T. Eller, Jr.
*Attorney, Agent, or Firm*—Seed and Berry

[57] ABSTRACT

A fluid-powered, laterally tiltable bucket assembly having a bucket with a pair of bucket clevises, and an actuator having a generally cylindrical body with an output shaft rotatably disposed therein with an axis in general parallel alignment with a forward rotation plane through which the bucket is rotatable on a backhoe arm by the operation of a rotation link. A bracket is attached to the body and has a pair of clevises for pivotal attachment to the vehicle arm and rotation link. The output shaft has a pair of shaft clevises for attaching the shaft to the corresponding bucket clevises. A linear-to-rotary transmission device disposed within the body produces rotational movement of the shaft relative to the body to produce lateral tilting of the bucket in a lateral plane generally transverse to the forward rotational plane for the bucket.

9 Claims, 3 Drawing Sheets

TILTABLE BUCKET ASSEMBLY

CROSS-REFERENCE TO RELATED APPLICATION

This is a continuation-in-part application of application Ser. No. 126,837, filed Nov. 30, 1987.

TECHNICAL FIELD

The present invention relates generally to buckets such as used with backhoes and excavators, and more particularly, to a bucket which is laterally tiltable.

BACKGROUND ART

Backhoes, excavators and similar type vehicles have an extendible or articulated arm with a bucket attached at an end thereof remote from the operator. Generally, a rotation link is associated with the arm. The bucket is pivotally attached to the arm by a clevis which serves as a pivot point for the bucket. The rotation link is also pivotally attached to the bucket so that movement of the rotation link causes the bucket to rotate about the arm pivot point. With such an arrangement, the bucket can be rotated relative to the arm in a generally vertical, forwardly extending plane defined by the arm and the rotation link, but lateral tilting of the bucket is not possible, at least without tilting of the vehicle. The arm and rotation link are usually not laterally tiltable relative to the vehicle to which they are attached.

There are occasions, however, when it would be very desirable to work with the bucket tilted to the left or right, such as when necessary to adjust for slope requirements or to do side angle grading. It is, of course, undesirable and often not possible to laterally tilt the entire vehicle to achieve tilting of the bucket.

This problem has been overcome with the advent of laterally tiltable buckets. Such buckets generally include a hinge adaptor which is attached to the arm and the rotation link, much in the same way buckets were directly attached in the past. The adaptor serves as a hinge and pivotally supports a bucket for lateral rotation of the bucket about a hinge axis which is generally aligned with the forward rotation plane through which the bucket is conventionally rotated. This allows the bucket to be laterally tilted from side to side. Control of the amount of lateral tilting is accomplished using a double-acting cylinder which extends laterally between the high adapter and the bucket to selectively cause the bucket to rotate about the hinge axis. Extension of the double-acting cylinder causes the bucket to rotate to one side, and retraction of the cylinder causes it to rotate to the other side.

To achieve the desirable range of tilting, such an arrangement has required a relatively long, double-acting cylinder. As such, only relatively wide buckets could accommodate the amount of extension and retraction of the double-acting cylinder required to laterally tilt the bucket to the extent desired. The more tilting required, the greater the space required to handle the double-acting cylinder to be used, because greater extension is needed. Of course, space limitations not only limit the length of the double-acting cylinder which can be used but also the torque output achievable with the cylinder. The use of a bucket that is wide enough to accommodate the elongated double-acting cylinders does not always solve these problems, because certain type jobs can best be done only with relatively narrow buckets. Typically, it is desired to have tiltable buckets tilt 45 degrees to the left and to the right relative to the vertical.

It will therefore be appreciated that there has been a significant need for a laterally tiltable bucket assembly which uses a relatively narrow width bucket. Furthermore, it is desirable that the bucket assembly be able to transmit a large torque to the bucket and firmly hold the bucket at the desired tilt angle. The present invention fulfills these needs and further provides other related advantages.

DISCLOSURE OF THE INVENTION

The present invention resides in a fluidpowered, laterally tiltable bucket assembly. The assembly is usable with a vehicle having an arm and a rotation link associated therewith for the rotation of the bucket assembly in a first plane defined by movement of the rotation link relative to the arm. Each of the arm and rotation link have an attachment member located toward a free end thereof.

The bucket assembly includes a bucket having a working edge extending laterally, generally transverse to the first plane. The bucket also has a first bucket attachment member located toward the working edge and a second bucket attachment member located away from the first attachment member. The first and second bucket attachment members are arranged in general parallel alignment with the first plane.

The bucket assembly further includes an actuator with a generally cylindrical body. The body has a longitudinal axis and a pair of ports for introducing pressurized fluid therein. The body further has an external first body attachment member located generally along the body axis toward a first body end for pivotal attachment of the vehicle arm to the arm attachment member and an external second body attachment member located generally along the body axis toward a second body for pivotal attachment of the rotation link to the rotation link attachment member. The first and second body attachment members are selectively detachable from the arm and rotation link attachment members. With the first body attachment member attached to the arm attachment member, movement of the rotation link causes the body to rotate about the vehicle arm with movement of the longitudinal axis of the body in general parallel alignment with the first plane.

The actuator also includes an output shaft rotatably disposed within the body and in general coaxial arrangement with the body. The output shaft has a first shaft portion extending at least to the first body end and a second shaft end portion extending at least to the second body end. The first shaft end portion has a first shaft attachment member fixedly attached thereto and located for attachment to the first bucket attachment member. The second shaft end portion has a second shaft attachment member attached thereto and located for attachment to the second bucket attachment member. The first and second shaft attachment members attach the bucket to the shaft for rotation with the shaft through a second plane extending laterally, generally transfers to the first plane.

The actuator further includes a linear-to-rotary transmission means disposed within the body and operable for producing rotational movement of the shaft relative to the body. The transmission means includes a piston for the selective application of fluid pressure through the ports to one or an other side thereof to produce linear movement of the piston within the body selectively toward the first and second body ends. The transmission means further include means for translating linear movement of the piston toward one of the first or second body ends into clockwise rotational movement of the shaft relative to the body and translating linear movement of the piston toward the other of the first or second body ends into counterclockwise rotational movement of the shaft relative to the body. As such, the bucket assembly is rotatable in the first plane and laterally tiltable in the second plane.

In a preferred embodiment of the invention, the first and second body attachment members form a part of an attachment bracket which is rigidly attached to the body.

Again in the preferred embodiment, the second shaft end portion extends beyond the second body end sufficiently to serve as a lever arm and provide mechanical advantage when the rotation link is moved relative to the vehicle arm to cause the bucket assembly to rotate in the first plane.

In accordance with another aspect of the invention, the body has at least one groove formed on an end of an inner surface thereof and the piston has means for engaging the body groove to apply torque between the body and the shaft. The shaft has a drive shaft portion extending generally coaxially within the body generally between the first and second body ends. The first shaft end portion is an annular flange portion located at the first body end. The flange portion projects generally radially outward from the drive shaft portion to and beyond the inner surface of the body. The bucket assembly further includes load-carrying bearing means disposed between the flange portion and the body at the first body end for allowing relative rotary motion between the shaft and the body. The bearing means includes a first ball race formed in the flange portion and a second ball race formed in the body toward the first body end, with a plurality of balls disposed between the first and second ball races. The second ball race is formed in a portion of the body radially outward of the deepest cut of the body groove formed on the inner body surface. The bearing means provide support against both axial thrust and radial loads applied to the flange portion.

Other features and advantages of the invention will become apparent from the following detailed description, taken in conjunction with the accompanying drawings.

BEST MODE FOR CARRYING OUT THE INVENTION

Figure 1:
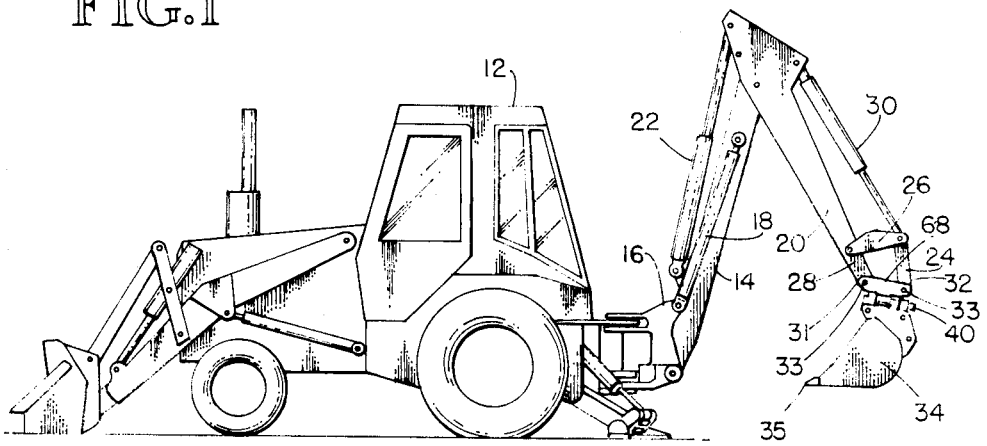
FIG. 1 is a side elevational view of a backhoe shown with a laterally tiltable bucket assembly embodying the present invention.
Figure 2:
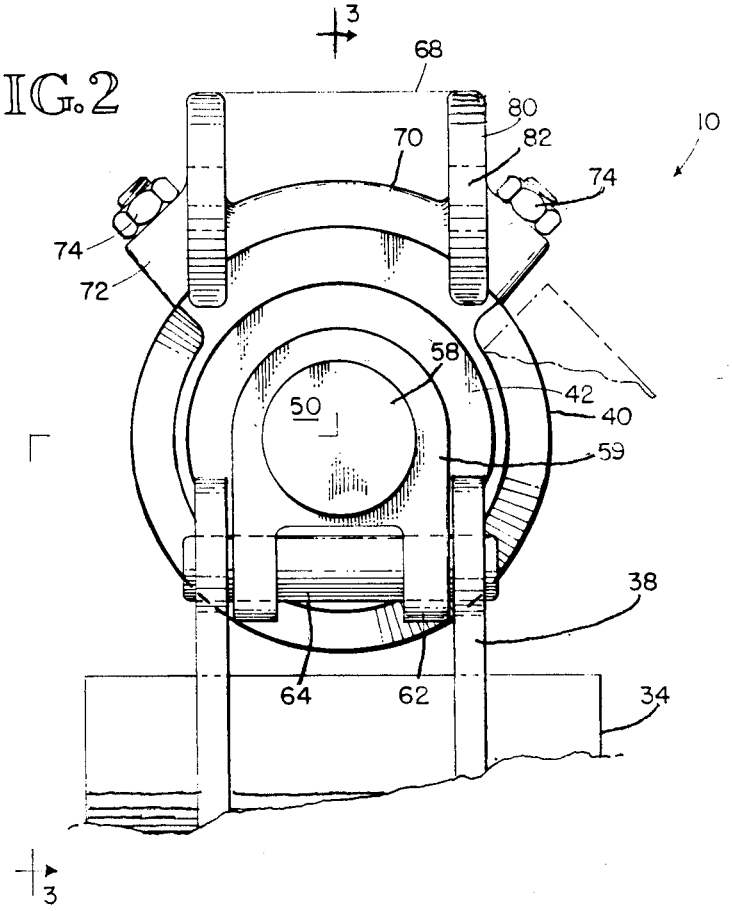
FIG. 2 is an enlarged, fragmentary, rear elevational view of the bucket assembly of FIG. 1, shown detached from the arm and rotation link of the backhoe.

As shown in the drawings for purposes of illustration, the present invention is embodied in a fluid-powered, laterally tiltable bucket assembly, indicated generally by reference numeral 10. As shown in FIG. 1, the bucket assembly is usable with a vehicle 12, such as the illustrated backhoe or any excavator or other vehicle that might use a bucket as a work implement. The vehicle 12 has a first arm 14 which is pivotally connected by one end to a base member 16. A pair of hydraulic cylinders 18 (only one being shown in FIG. 1) are provided for raising and lowering the first arm in a generally forwardly extending vertical plane with respect to the base member 16. A second arm 20 is pivotally connected by one end to an end of the first arm 14 remote from the base member 16. Ahydraulic cylinder 22 is provided for rotation of the second arm 20 relative to the first arm 14 in the same vertical forward rotation plane as the first arm operates. The base member 16 is pivotally attached to the vehicle 12 for pivotal movement about a vertical axis so as to permit movement of the first and second arms 14 and 20 in unison to the left or right, with the first and second arms always being maintained in the forward rotation plane. It is noted that while the forward rotation plane is referred to as being forwardly extending for convenience of description, as the base member 16 is pivoted the forward rotation plan turns about the vertical pivot axis of the base member and thus to a certain extent loses its forward to rearward orientation, with the plane actually extending laterally should the base member be sufficiently rotated.

A rotation link 24 is pivotally connected through an interconnecting link 26 to an end portion 28 of the second arm 20 remote from the point of attachment of the second arm to the first arm 14. A hydraulic cylinder 30 is provided for selective movement of the rotation link 24 relative to the second arm 20.

As is conventional, a free end portion 31 of the second arm 20 and a free end portion 32 of the rotation link 24 each has a transverse aperture therethrough for connection of the second arm and the rotation link to a conventional bucket using a pair of selectively removable attachment pins 33. The attachment pins 33 are insertable in the apertures to pivotally connect the conventional bucket to the second arm and the rotation link. When using the conventional bucket, this permits the bucket to be rotated about the attachment pin of the second arm 20 upon movement of the rotation link 24 relative to the second arm as a result of extension or retraction of the hydraulic cylinder 30 to rotate the bucket in the forward rotation plane defined by the first and second arms 14 and 20.

In the presently preferred embodiment of the invention, a conventional bucket 34 of relatively narrow, twelve-inch width is utilized. The bucket has a forward working edge 35 (see FIG. 1) extending laterally, generally transverse to the forward rotation plane of the bucket. The bucket 34 further includes a first bucket clevis 36 located toward the bucket working edge 35 and a second bucket clevis 38 located rearwardly away from the first bucket clevis. The first and second bucket clevises are in general parallel alignment with the forward rotation plane of the bucket.

The bucket assembly 10 of the present invention further includes a rotary actuator 40 having an elongated housing or body 42 with a cylindrical side wall 44 and first and second ends 46 and 48, respectively. An elongated rotary output shaft 50 is coaxially positioned within the body 42 and supported for rotation relative to the body.

The shaft 50 includes a central elongated portion 51 axially projecting substantially the full length of the body 12, a radially outward projecting annular flange portion 52 at the first body end 46, and an exteriorly extending shaft portion 53 extending beyond and exterior of the body at the second body end 48. The central elongated shaft portion 51, the flange portion 52, and the exteriorly extending shaft portion 53 are formed as an integral unit, such as from a single piece of machined stock. The central elongated shaft portion 51 has an annular nut 54 threadably attached thereto at the second body end 48. The shaft nut 54 has a threaded interior portion threadably attached to a correspondingly threaded perimeter portion 55 of the central elongated shaft portion 51 and the shaft nut rotates with the shaft 50.

The flange portion 52 is positioned at the first body end 46 to provide a flat, outwardly facing mounting surface 63 to which can be attached a first attachment flange 56 for rotation with the shaft 50 relative to the body 42. Alternatively, the first attachment flange 56 can be formed integrally with the flange portion 52. The shaft flange portion 52 has a plurality of outwardly opening, threaded holes 56 circumferentially spaced thereabout away from the central rotational axis of the shaft 50 for rigid coupling of the first attachment flange 56 to the shaft flange portion 52 by a plurality of threaded studs and nuts 57. The first attachment flange 56 has the rotational drive of the shaft 50 transmitted thereto so as to provide the torque needed for tilting the bucket 34 to the desired lateral tilt angle and for holding the bucket in that position while the bucket performs the desired work.

The exteriorly extending shaft portion 53 has mounted at a free end portion 58 thereof a second attachment flange 59. While the second attachment flange 59 is securely attached to the shaft 50, it is not rigidly attached in the manner intended to transmit rotational drive to the second attachment flange in order to provide the torque needed to tilt the bucket 34, as is the first attachment flange 56. Nevertheless, the second attachment flange 59 will rotate with the shaft 50 as a result of the rotational drive transmitted thereto through the first attachment flange 56 via the bucket 34 to which the first and second attachment flanges 56 and 59 are attached, as will be described below. More significantly, the second attachment flange 59 primarily serves to transmit the rotational force to the bucket 34 produced by the movement of the rotation link 24 relative to the second arm 20 in order to cause the bucket to be selectively rotated through the forward rotation plane. By location of the second attachment flange 59 at the free end portion 58 of the shaft 50 which is significantly rearward of the second body end 48 and the end portion 31 of the second arm 20, the exteriorly extending shaft portion 53 acts as a long lever arm. This provides desirable mechanical advantage to cause the entire bucket assembly 10, and hence the bucket 34 comprising a part thereof, to rotate about the attachment pin 33 of the second arm 20 as the rotation link 24 is moved relative to the second arm by the hydraulic cylinder 30. As will be described below, the body 42 of the actuator 40 is pivotally attached to the second arm 20 and the rotation link 24, much in the same manner as a conventional bucket would be attached.

The first attachment flange 56 has a downwardly projecting flange clevis 60 for mating with the corresponding first bucket clevis 36 and the second attachment flange 59 has a downwardly projection flange clevis 62 for mating with the corresponding second bucket clevis 38 for attachment of the bucket 34 to the actuator 40 at a position therebelow using selectively removable attachment pins 64. By the use of selectively removable attachment pins 64, the bucket 34 can be quickly and conventiently removed from the actuator 40 for attachment directly to the second arm 20 and the rotation link 24 should it be desired to use the vehicle 12 as a conventional backhoe without the capability provided by a laterally tiltable bucket. This also allows for easy attachment of a different size or style bucket or other device to the actuator as the job demands.

An attachment bracket 68 is used to detachably connect the body 42 to the second arm 20 and the rotation link 24 in a position therebelow in general alignment with the forward rotation plane. Alternatively, the attachment bracket 68 can be formed integrally with the body 42. The attachment bracket 68 has a saddle portion 70 which rides upon an upper portion of the body sidewall 44. The saddle portion 40 has a left side pair and a right side pair of smooth bore apertures (not shown) therethrough which are aligned with two pairs of threaded holes (not shown) in the body sidewall 44 for rigid coupling of the attachment bracket 68 to the body 42 by a pair of threaded studs and nuts 74.

The attachment bracket 68 further includes a first attachment clevis 76 with an aperture 78 therein sized to receive one of the attachment pins 33 to pivotally connect the body 42 to the vehicle second arm 20 at its free end portion 31, and a second attachment clevis 80 with an aperture 82 therein sized to receive the other of the attachment pins 33 to pivotally connect the body to the rotation link 24 at its free end portion 32. By the use of selectively removable attachment pins 33, the bucket assembly 10 can be quickly and conveniently removed from the second arm 20 and the rotation link 24 when it is not desired to use the bucket assembly.

With the tiltable bucket assembly 10 of the present invention, a compact, fluid-powered actuator 40 is used with a design which requires far less space, particularly with respect to the size in the lateral direction compared to when using double-acting cylinders to rotate a tilt bucket. This allows the construction of a tiltable bucket assembly with a very narrow width bucket. Furthermore, the bucket assembly can be used with conventional buckets and thus can be retrofitted onto vehicles with existing buckets without requiring purchase of a new bucket.

Within the body 42, an annular piston sleeve 84 is coaxially and reciprocally mounted coaxially about the shaft 50. The piston sleeve 84 has an elongated annular head portion 86 positioned toward the second body end 48 and a cylindrical sleeve portion 88 fixedly attached to the head portion and extending axially therefrom toward the first body end 46.

The head portion 86 carries a pair of conventional inner seals, disposed to provide a seal between the head portion and a corresponding, longitudinally extending, smooth wall portion of the shaft 50. The body sidewall 44 has a pair of stationary seals positioned along a mid-portion of the sidewall, disposed to provide a seal between the body sidewall and a corresponding, longitudinally extending, smooth wall portion of the head portion 86. The head portion 86 and the corresponding stationary seals and inner seals define fluid-tight compartments to each side of the head portion toward the first body end 46 and the second body end 48. The smooth wall portion of the shaft 50 and the smooth wall portion of the sleeve portion 88 have sufficient axial length to accommodate the full end-to-end reciprocating stroke travel of the piston sleeve 84 within the body 42.

Reciprocation of the piston sleeve 84 within the body 42 occurs when hydraulic oil or air under pressure selectively enters through one or the other of a port 90 and a port 92 located in the body sidewall 44, each adjacent to an axially opposite side of the stationary seals of the body sidewall. As used herein, "fluid" will refer to hydraulic oil, air or any other fluid suitable for use in the actuator 40. The ports 90 and 92 each communicate with one of the fluid-tight compartments correspondingly positioned to one or the other side of the piston head portion 86. Conventional seals are disposed between the shaft flange portion 52 and the body 42 toward the first body end 46 and between the shaft nut 60 and the body 42 toward the second body end 48 to prevent fluid leakage from the compartments as the shaft 80 rotates. Access to the ports 90 and 92 is provided by a pair of apertures 94 in the saddle portion 70 of the attachment bracket 68.

The application of fluid pressure to the compartment toward the first body end 46 produces axial movement of the piston sleeve 84 toward the second body end 48. The application of fluid pressure to the compartment toward the second body end 48 produces axial movement of the piston sleeve 84 toward the first body end 46. The actuator 40 provides relative rotational movement between the body 42 and the shaft 50 through the conversion of linear movement of the piston sleeve 84 into rotational movement of the shaft in a manner well known in the art.

An inward facing surface portion 96 of the body sidewall 44 extending generally between the stationary seals and the first body end 46 has cut therein a plurality of inner helical body grooves 98. An outward facing surface portion 100 of the shaft 50 extending generally between the shaft smooth wall portion toward the shaft flange portion 52 has cut therein a plurality of outer helical shaft grooves 102. The helical body and shaft grooves 98 and 102 extend about the body sidewall 44 and the shaft 50, respectively. The grooved shaft portion 100 is located generally opposite the grooved body portion 96 and spaced apart radially inward therefrom to define a cicumferential space therebetween. The sleeve portion 88 of the piston sleeve 84 supports a plurality of free rotatable rollers 104 disposed in the circumferential space between the shaft 50 and the body sidewall 44. The helical body grooves 98 have an opposite hand or direction of turn from the helical shaft grooves 102, but have substantially the same axial pitch as the helical shaft grooves. The number of grooves or groove starts comprising the plurality of helical body and shaft grooves 98 and 102 may vary from design to design, but preferably the numbers used are interrelated.

The rollers 104 are disposed in a circumferentially aligned row in the circumferential space between the grooved body portion 96 and the grooved shaft portion 100 and transmit force therebetween. The rollers 104 each have an outward facing surface with a plurality of circumferential grooves with circumferential ridges therebetween. The circumferential grooves and ridges of each roller 104 extend about the roller in parallel, spaced-apart radial planes. The circumferential ridges of the rollers 104 have substantially the same axial pitch as the helical body and shaft grooves 98 and 102. The grooved body portion 96 has a first pitch diameter PD1 and the grooved shaft portion 70 has a second pitch diameter PD2. The rollers 104 have a pitch diameter PD3 sized based upon the first pitch diameter PD1 of the grooved body portion 96 and the second pitch diameter PD2 of the grooved shaft portion 100, substantially according to the relationship:

$$PD3 = \frac{PD1 - PD2}{2}$$

As used herein, "pitch diameter" is the diameter of the grooved part measured from the groove half-depth position.

The rollers 104 are rotatably retained in fixed axial and circumferential position relative to the piston sleeve 84 as the piston sleeve reciprocates within the body 42 during fluid-powered operation of the actuator 40 by a plurality of cylindrical shaft spindles 106. Each of the spindles 106 has a coaxially extending and integrally formed support arm portion 108 disposed in one of a plurality of bore holes 110 formed in the piston sleeve 84. The bore holes 110 are evenly circumferentially spaced apart about the piston sleeve 84 and axially extending fully through the sleeve portion 88 and the piston head portion 86 of the piston sleeve.

The support arm portion 108 has a head 112 received in a countersunk end portion 114 of the bore hole 110 in the piston head portion 86 to recess the support arm head and thus prevent it from being exposed to impact when the head portion 86 of the piston sleeve 84 reaches its full end limit of travel toward the second body end 48. A conventional seal (not shown) is provided to prevent fluid leakage between the compartments to each side of the piston head portion 86.

At the first body end 46, the spindles 106 project into the circumferential space between the body sidewall 44 and the shaft 50 and hold the rollers 104 restrained against axial movement relative to the spindles for rotation about the spindles on axes in parallel axial alignment with the body 42. In alternative constructions, the spindles may be designed to hold the rollers at a skewed angle.

The spindles 106 retain the rollers 104 in circumferentially distributed, spaced-apart positions within the circumferential space about the shaft 50 with each of the rollers in seated engagement and coacting with the helical body grooves 98 and the helical shaft grooves 102 for transmitting force between the body 42, the shaft 50 and the piston sleeve 84. Each ridge of the rollers 104 is positioned for rolling travel in corresponding grooves of both the helical body grooves 98 and the helical shaft grooves 102, and the corresponding ridges of adjacent rollers are axially positioned in generally the same plane or may be axially offset from one another, as desired.

Each of the spindles 106 has one of the rollers 104 coaxially and rotatably retained thereon and restrained against axial movement relative to the spindle. The rollers 104 each have a longitudinally extending coaxial roller bore with a self lubricating coating for rotatably receiving a smooth surface end portion of one of the spindles 106 projecting outward beyond the end of the sleeve portion 88 of the piston sleeve 84. The spindle end portion also has a self lubricating coating. The roller 104 is held in place on the spindle 106 by an annular spindle support plate 116. The support plate 116 has a plurality of circumferentially spaced-apart, threaded holes arranged so each hole threadably receives a threaded free end portion of one of the spindles therein. The support plate 116 reduces problems and possible failure under large loads which may be encountered by the cantilever-supported spindles.

Figure 3:
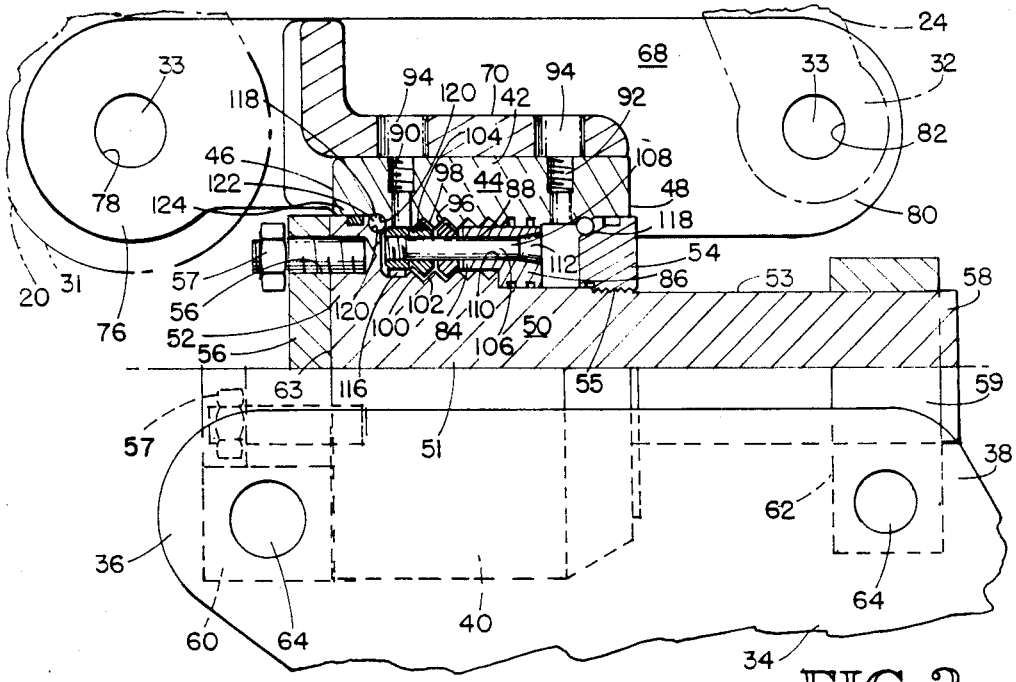
FIG. 3 is an enlarged, fragmentary, side elevational view of the bucket assembly of FIG. 1, with the actuator of the bucket assembly shown in partial sections taken substantially along the line 3—3 of FIG. 2.
Figure 4:
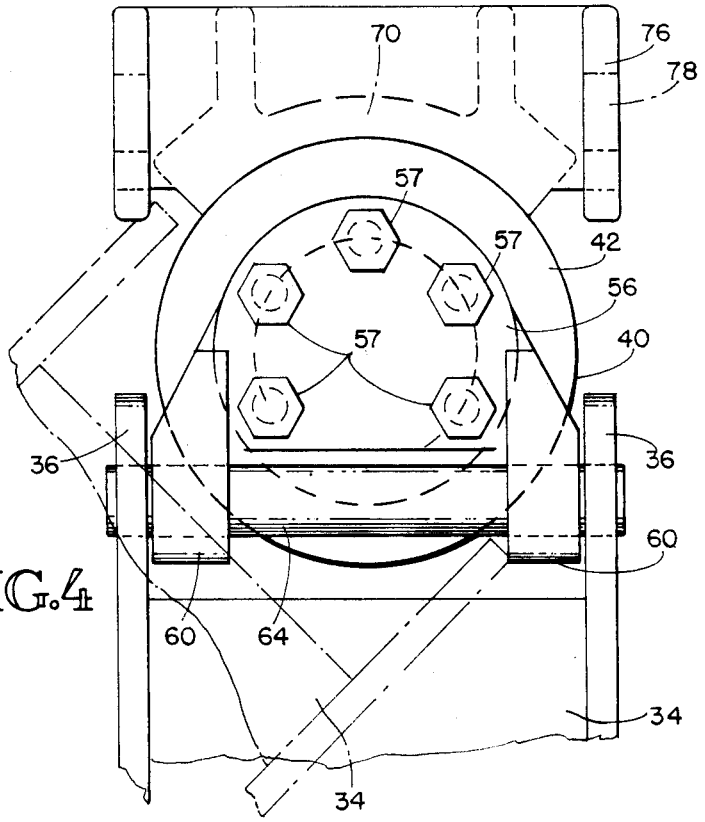
FIG. 4 is an enlarged, fragmentary, front elevational view of the bucket assembly of FIG. 1 shown detached from the arm and rotation link of the backhoe, with the bucket shown in phantom line rotated to a laterally tilted position.
Figure 5:
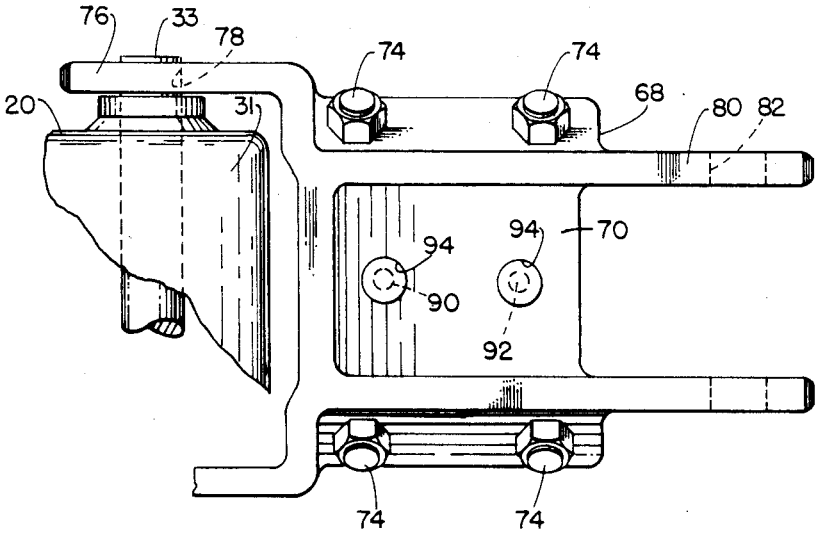
FIG. 5 is a top plan view of an attachment bracket used with the bucket assembly of FIG. 1, with the actuator of the bucket assembly detached and the arm of the backhoe shown fragmentarily.
Figure 6:
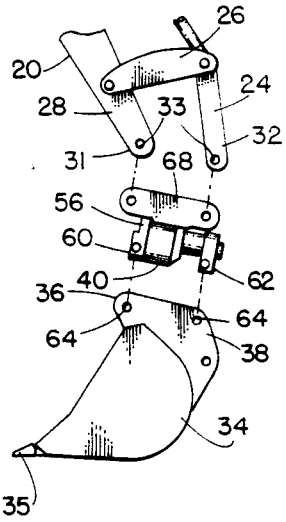
FIG. 6 is an enlarged, fragmentary, exploded, side elevational view of the tiltable bucket assembly of FIG. 1.

In the illustrated embodiment of the invention in FIG. 3, each of the rollers 104 comprises two annular roller disks independently and rotatably disposed on the spindle end portion in juxtaposition. The two roller disks operate together to form the roller 104. The coaction of the rollers 104 and the helical body and shaft grooves 98 and 100 comprise the linear-to-rotary conversion means which produces rotation of the shaft 50 as the piston sleeve 84 reciprocates, as will now be described.

Linear reciprocation of the piston sleeve 84 produces rotation of the piston sleeve and the shaft 50 through the force-transmitting capability of the rollers 104. Through the selective application of fluid pressure to one or the other of the fluid-tight compartments, torque is transmitted by the rollers 104 to the piston sleeve 84 through their coaction with the helical body grooves 98. The axial force created by fluid pressure on the head portion 86 causes the rollers 104 to roll along the helical body grooves 98 and transmit torque to the piston sleeve 84. The transmitted torque causes the piston sleeve 84 to rotate as it moves axially. The resulting linear and rotational movement of the piston sleeve 84 transmits both axial and rotational force to the shaft 50 through the coaction of the rollers 104 with the helical shaft grooves 102. The transmitted force causes the shaft 50 to rotate relative to the body 42 since axial movement of the shaft is restricted by thrust bearings 118 positioned toward the first body end 46 between the shaft flange portion 52 and the body sidewall 44 and positioned toward the second body end 48 between the shaft nut 54 and the body sidewall. As such, axial movement of the piston sleeve 84 produced by fluid pressure is converted into relative rotational movement between the body 42 and the shaft 50. The resulting movement of the rollers 104, body 42 and shaft 50 when viewed from the body ends is much like the movement of a planetary gear arrangement. Alternative linear-to-rotary conversion means may also be used, such as intermeshing slines or balls and ball grooves.

The actuator 40 is provided with means for eliminating backlash in the force-transmitting parts and for axially preloading of the piston sleeve 84 and the rollers 104. Backlash results for the slack or free movement between the force-transmitting parts of the actuator. The slack is usually due to the sizing of the grooves of the body 42 and shaft 50, and the rollers 104 positioned therein, which transmit force between the body and the shaft through the reciprocation of the piston sleeve 84. Backlash occurs as the piston sleeve moves from one axial direction to the other within the body as it reciprocates.

As previously described, each of the spindles 106 has a roller 104 rotatably mounted thereon, and each roller is comprised of two roller disks. To provide for backlash elimination and preloading, the roller disks are sized to produce an adjustment space therebetween when installed on the spindle end portion and positioned within the body 42 with the shaft 50 and piston sleeve 84 in place. As will be described, this adjustment space allows for sufficient axial movement of the roller disks toward each other to firmly engage between the ridge portions of the two roller disks one of the ridge portions of the helical body grooves 98 and one of the ridge portions of the helical shaft grooves 102.

The two roller disks of the roller 104 are selectively and adjustably moved toward each other by adjustably turning the spindle 106 carrying the two roller disks using a tool inserted into a recess (not shown) for the spindle support arm head 112 of the spindle with the shaft nut 54 removed prior to fluid-powered operation of the actuator 40. By so adjustably turning the support arm head 112, the support plate 116 is drawn toward the second body end 48 and the two roller disks of the roller 104 being adjusted are caused to be moved together and clamp therebetween the ridge portions of the corresponding helical body and shaft grooves 98 and 102. Unlike with some forms of backlash elimination, this leaves one of the two roller disks of each roller 104 in firm rolling engagement with the ridge portions of the body and shaft grooves 98 and 102, whether the piston sleeve 84 is traveling axially toward the first body end 46 or the second body end 48. Thus each roller 104 in the set of rollers of the piston sleeve 84 carries part of the load regardless of the direction of axial travel of the piston sleeve.

This is to be compared to other backlash elimination approaches that axially adjustably move every other one of the rollers relative to the other rollers to remove slack, where the entire roller is moved axially. By so doing, when under fluid-powered operation, the adjustment leaves only one-half of the total number of rollers in driving engagement with the ridge portions of the body and shaft grooves when the piston sleeve moves in one axial direction and only the other one-half of the rollers in driving engagement when the piston sleeve moves in the opposite axial direction. Since only one-half of the rollers are in driving engagement at any one time, the load carrying ability of the actuator is less than otherwise possible if all rollers were in driving engagement at all times, such as accomplished with the actuator 40.

Since the turning of one spindle 106 to adjust out slack and to preload the rollers 104 also causes the annular support plate 116 to have a similar effect, although to a lesser extent, on the other rollers, the backlash elimination adjustment should be accomplished by progressively turning of all spindles in sequence to partially and gradually adjust out backlash, rather than attempting to fully adjust backlash out of one spindle before adjusting the other spindles.

When substantially all slack between the rollers 104 and the helical body grooves 98 and between the rollers and the shaft grooves 102 has been eliminated, further axial adjustment of the roller disks will apply an axial preloading force between the rollers and the helical body and shaft grooves. The spindles 106 may then be locked in place against further rotation using lock screws (not shown), and the shaft nut 54 replaced on the shaft 50 to ready the actuator 40 for fluid powered operation. Should usage of the actuator 40 cause wear of the grooves or the rollers seated therein, or should slack occur for any other reason, the slack can be removed in the same manner described above by further axial adjustment of the spindles after the shaft nut 54 is removed. No other disassembly of the actuator 40 is required. It is noted that the backlash elimination described will eliminate a generally equal amount of slack between the rollers 104 and the helical body grooves 98 and between the rollers and the helical shaft grooves 102.

As shown in FIG. 3, the thrust bearing 118 at the first body end 46 includes confronting and corresponding circular ball races 120 integrally formed in the shaft flange portion 52 and the body sidewall 44, with a plurality of balls 122 disposed between the ball races. With this arrangement, the thrust bearing 118 serves to rotatably support the shaft 50 against both axial and radial thrust loads with a single bearing. By use of the radially extending shaft flange portion 52 and the thrust bearing 118 radially distant from the shaft rotational axis, the ability of the actuator 40 to handle high moments applied to the shaft 50 is substantially improved. To further provide a strong construction for the actuator 40 against axial thrust loads, the circular ball race 120 of the body sidewall 44 has a diameter measured from the shaft rotational axis larger than the diameter of the deepest cut of the helical body grooves 98 in the body sidewall. In other words, the pitch diameter of the thrust bearing 118 is larger than the minor diameter of the helical body grooves 98. Thus, axial thrust loading on the shaft 50 is transmitted through the ball races 120 of the flange portion 52 and the balls 122 to the ball race 120 of the body sidewall 44 through a solid wall portion of the body sidewall located radially outward of the helical body grooves 98. As such, the body sidewall and its axial thrust load-carrying ability is not weakened by the cutting of the helical body grooves 98 therein. Loads are, therefore, not applied to that inwardly located portion of the body sidewall undercut by the helical body grooves 98 and having less shear strength. To allow for sufficient radial extension of the shaft flange portion 52, the body sidewall 44 at the first body end 46 has a recessed interior sidewall portion 124 with a larger diameter than the adjacent inwardly facing surface portion 96 of the body sidewall in which the helical body grooves 98 are cut.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered, laterally tiltable bucket assembly, usable with a vehicle having an arm and a rotation link associated therewith for rotation of the bucket assembly in a first plane defined by movement of the rotation link relative to the arm, each of the arm and rotation link having an attachment member located toward a free end thereof, the bucket assembly comprising:

a bucket having a working edge extending laterally, generally transverse to the first plane, a first bucket attachment member located toward said working edge and a second bucket attachment member located away from said first attachment member, said first and second bucket mounting attachment members being arranged in general parallel alignment with the first plane;

a generally cylindrical body having a longitudinal axis and a pair of ports for introducing pressurized fluid therein;

an attachment bracket rigidly attached to said body and having an external first bracket attachment member located generally along said body axis toward a first body end of said body for pivotal attachment to the vehicle arm by the arm attachment member and an external second bracket attachment member located generally along said body axis toward a second body end of said body for pivotal attachment to the rotation link by the rotation link attachment member, said first and second bracket attachment members being selectively detachable from the arm and rotation link attachment members, respectively, wherein with said first bracket attachment member attached to the arm attachment member, movement of the rotation link causes said body to rotate about the vehicle arm with movement of said longitudinal axis of said body in generally parallel alignment with the first plane, and wherein the bucket assembly is selectively detachable from the vehicle arm and rotation link;

an output shaft rotatably disposed within said body in general coaxial arrangement with said body and having a first shaft end portion extending at least to said first body end and a second shaft end portion extending at least to said second body end, said first shaft end portion having a first shaft attachment member located for attachment to said first bucket attachment member and said second shaft end portion having a second shaft attachment member located for attachment to said second bucket attachment member, said first and second shaft attachment members attaching said bucket to said shaft for rotation with said shaft through a second plane extending laterally, generally transverse to the first plane; and linear-to-rotary transmission means disposed within said body and operable for producing rotational movement of said shaft relative to said body, said transmission means including a piston for the selective application of fluid pressure through said ports to one or an other side thereof to produce linear movement of said piston within said body selectively toward said first and said second body ends, and means for translating linear movement of said piston toward one of said first or second body ends into clockwise rotational movement of said shaft relative to said body and translating linear movement of said piston toward the other of said first or second body ends into counterclockwise rotational movement of said shaft relative to said body, whereby said bucket assembly is rotatable in the first plane and laterally tiltable in the second plane.

2. The bucket assembly of claim 1 wherein said second shaft end portion extends beyond said second body end sufficiently to serve as a lever arm and provide mechanical advantage when the rotation link is moved relative to the vehicle arm to cause the bucket assembly to rotate in the first plane.

3. The bucket assembly of claim 1 wherein said body has at least one groove formed on an end of an inner surface thereof and said piston has means for engaging said body groove to apply torque between said body and said shaft; wherein said shaft has a drive shaft portion extending generally coaxially within said body generally between said first and second body ends, and said first shaft end portion is an annular flange portion located at said first body end, said flange portion projecting generally radially outward from said drive shaft portion to and beyond said inner surface of said body; and wherein the bucket assembly further includes load-carrying bearing means disposed between said flange portion and said body at said first body end for allowing relative rotary motion between said shaft and said body, said bearing means including a first ball race formed in said flange portion and a second ball race formed in said body towards said first body end, with a plurality of balls disposed between said first and second ball races, said second ball race being formed in a portion of said body radially outward of the deepest cut of said body groove formed on said inner body surface, said bearing means providing support against both axial thrust and radial loads applied to said flange portion.

4. A fluid-powered bucket actuator, usable with a vehicle having an arm and a rotation link associated therewith for rotation of a bucket in a first plane defined by movement of the rotation link relative to the arm, each of the arm and rotation link having a transverse aperture located toward a free end thereof to receive a selectively removable attachment member, and useable with a bucket having a working edge extending laterally, generally transverse to the first plane, a first bucket clevis located toward the working edge and a second bucket clevis located away from the first clevis, the first and second bucket clevis being arranged in general parallel alignment with the first plane, the actuator comprising:

a generally cylindrical body having a longitudinal axis and a pair of ports for introducing pressurized fluid therein, said body having an external first body clevis located generally along said body axis toward a first body end of said body for pivotal attachment to the vehicle arm by the arm aperture and the selectively removable attachment member therefor and an external second body clevis located generally along said body axis toward a second body end of said body for pivotal attachment to the rotation link by the rotation link aperture and the selectively removal attachment member therefor, wherein with said first body clevis attached to the vehicle arm, movement of the rotation link causes said body to rotate about the vehicle arm with movement of said longitudinal axis of said body in generally parallel alignment with the first plane and wherein said body is selectively detachable from the vehicle arm and rotation link by removal of the attachment members;

an output shaft rotatably disposed within said body in general coaxial arrangement with said body and having a first shaft end portion extending at least to said first body end and a second shaft end portion extending at least to said second body end, said first shaft end portion having a first shaft attachment member attached thereto and located for attachment to the first bucket clevis and said second shaft end portion having a second shaft attachment member attached thereto and located for attachment to the second bucket clevis, said first and second shaft attachment members attaching the bucket to said shaft for rotation with said shaft through a second plane extending laterally generally transverse to the first plane; and linear-to-rotary transmission means disposed within said body and operable for producing rotational movement of said shaft relative to said body, said transmission means including a piston for the selective application of fluid pressure through said ports to one or an other side thereof to produce linear movement of said piston within said body selectively toward said first and said second body ends, and means for translating linear movement of said piston toward one of said first or second body ends into clockwise rotational movement of said shaft relative to said body and translating linear movement of said piston toward the other of said first or second body ends into counterclockwise rotational movement of said shaft relative to said body, whereby the bucket is rotatable in the first plane and laterally tiltable in the second plane.

5. The bucket actuator of claim 4 wherein said second shaft end portion extends beyond said second body end sufficiently to serve as a lever arm and provide mechanical advantage when the rotation link is moved relative to the vehicle arm to cause the bucket to rotate in the first plane.

6. The bucket actuator of claim 4 wherein said body has at least one groove formed on an end of a inner surface thereof and said piston has means for engaging said body groove to apply torque between said body and said shaft; wherein said shaft has a drive shaft portion extending generally coaxially within said body generally between said first and second body ends, and said first shaft end portion is an annular flange portion located at said first body end, said flange portion projecting generally radially outward from said drive shaft portion to and beyond said inner surface of said body; and wherein the bucket actuator further includes load-carrying bearing means disposed between said flange portion and said body at said first body end for allowing relative rotary motion between said shaft and said body, said bearing means including a first ball race formed in said flange portion and a second ball race formed in said body towards said first body end, with a plurality of balls disposed between said first and second ball races, said second ball race being formed in a portion of said body radially outward of the deepest cut of said body groove formed on said inner body surface, said bearing means providing support against both axial thrust and radial loads applied to said flange portion.

7. A fluid-powered, laterally tiltable bucket assembly, usable with a vehicle having an arm and a rotation link associated therewith for rotation of the bucket assembly in a first plane defined by movement of the rotation link relative to the arm, each of the arm and rotation link having an attachment member located toward a free end thereof, the bucket assembly comprising:

a bucket having a working edge extending laterally, generally transverse to the first plane, a first bucket attachment member located toward said working edge and a second bucket attachment member located away from said first attachment member, said first and second bucket mounting attachment members being arranged in general parallel alignment with the first plane;

a generally cylindrical body having a longitudinal axis and a pair of ports for introducing pressurized fluid therein;

an attachment bracket rigidly attached to said body and having an external first body attachment member located generally along said body axis toward a first body end of said body for pivotal attachment to the vehicle arm by the arm attachment member and an external second body attachment member located generally along said body axis toward a second body end of said body for pivotal attachment to the rotation link by the rotation link attachment member, said first and second body attachment members being selectively detachable from the arm and rotation link attachment members, respectively, wherein with said first attachment member attached to the arm attachment members, movement of the rotation link causes said body to rotate about the vehicle arm with movement of said longitudinal axis of said body in generally parallel alignment with the first plane, and wherein the bucket assembly is selectively detachable from the vehicle arm and rotation link;

an output shaft rotatably disposed within said body in general coaxial arrangement with said body and having a first shaft end portion extending at least to said first body end and a second shaft end portion extending at least to said second body end, said first shaft end portion having a first shaft attachment member attached thereto and located for attachment to said first bucket attachment member and said second shaft end portion having a second shaft attachment member fixedly attached thereto and located for attachment to said second bucket attachment member, said first and second shaft attachment members attaching said bucket to said shaft for rotation with said shaft through a second plane extending laterall, generally transverse to the first plane; and linear-to-rotary transmission means disposed within said body and operable for producing rotational movement of said shaft relative to said body, said transmission means including a piston for the selective application of fluid pressure through said ports to one or an other side thereof to produce linear movement of said piston within said body selectively toward said first and said second body ends, and means for translating linear movement of said piston toward one of said first or second body ends into clockwise rotational movement of said shaft relative to said body and translating linear movement of said piston toward the other of said first or second body ends into counterclockwise rotational movement of said shaft relative to said body, whereby said bucket assembly is rotatable in the first plane and laterally tiltable in the second plane.

8. The bucket assembly of claim 7 wherein said second shaft end portion extends beyond said second body end sufficiently to serve as a lever arm and provide mechanical advantage when the rotation link is moved relative to the vehicle arm to cause the bucket assembly to rotate in the first plane.

9. The bucket assembly of claim 7 wherein said body has at least one groove formed on an end of an inner surface thereof and said piston has means for engaging said body groove to apply torque between said body and said shaft; wherein said shaft has a drive shaft portion extending generally coaxially within said body generally between said first and second body ends, and said first shaft end portion is an annular flange portion located at said first body end, said flange portion projecting generally radially outward from said drive shaft portion to and beyond said inner surface of said body; and wherein the bucket assembly further includes load-carrying bearing means disposed between said flange portion and said body at said first body end for allowing relative rotary motion between said shaft and said body, said bearing means including a first ball race formed in said flange portion and a second ball race formed in said body towards said first body end, with a plurality of balls disposed between said first and second ball races, said second ball race being formed in a portion of said body radially outward of the deepest cut of said body groove formed on said inner body surface, said bearing means providing support against both axial thrust and radial loads applied to said flange portion.

* * * * *